United States Patent [19]

Roche

[11] 4,360,761

[45] Nov. 23, 1982

[54] FLUORESCENT LAMP STARTING AID HAVING AN INTEGRAL COUPLING IMPEDANCE

[75] Inventor: William J. Roche, Merrimac, Mass.

[73] Assignee: GTE Products Corporation, Stamford, Conn.

[21] Appl. No.: 181,300

[22] Filed: Aug. 25, 1980

[51] Int. Cl.[3] ..... H01J 61/56; H01J 61/42

[52] U.S. Cl. ..... 315/60; 313/198; 313/201; 313/492; 313/493

[58] Field of Search ..... 315/60, 58; 313/492, 313/201, 493, 198

[56] References Cited

U.S. PATENT DOCUMENTS 2,683,836 7/1954 Lemmers ..... 315/60 X 3,753,036 8/1973 Roche ..... 315/60

4,153,861 5/1979 Warner et al. ..... 313/201 X

FOREIGN PATENT DOCUMENTS 954275 12/1956 Fed. Rep. of Germany ..... 313/201

*Primary Examiner*—Palmer C. Demeo

*Attorney, Agent, or Firm*—William H. McNeill

[57] ABSTRACT

A starting aid for a fluorescent lamp is formed from a metallized, insulating tape carrying an adhesive on the metallized surface. An integral coupling impedance is formed on one end of the starting aid by an adhesive backed insulating tape which is attached to a metal foil. The metal foil carries a connecting wire which is attached to one of the lead-in wires of the lamp. The lead-in wire potential is thus capacitively coupled to the metallized layer of the starting aid.

3 Claims, 4 Drawing Figures

FLUORESCENT LAMP STARTING AID HAVING AN INTEGRAL COUPLING IMPEDANCE

TECHNICAL FIELD

This invention relates to fluorescent lamps and more particularly to starting aids therefor.

BACKGROUND ART

Starting aids in the form of a conductive stripe on the outside of a fluorescent lamp have been employed. The effectiveness of such stripes can be enhanced by electrically connecting one end of the stripe to one of the lamp base pins by means of a high impedance element such as a discrete resistor or capacitor. Such types of starting aids are relatively expensive and difficult to apply. Also, the connecting impedance must be welded or soldered to both the base pin and the stripe.

In lamps which employ metal base caps it is possible to paint the stripe (usually formed from a conductive paint) along the lamp and onto the base cap to eliminate soldering; however, starter function can be impaired if the base cap should become loosened and break the connection of the base cap and stripe. Further, this latter method can not be employed with plastic or non-electrically conductive base caps.

DISCLOSURE OF THE INVENTION

It is, therefore, an object of the invention to obviate the disadvantages of the prior art.

It is another object of the invention to enhance lamp starting aids.

These objects are accomplished, in one aspect of the invention, by the provision of a starting aid for a fluorescent lamp which starting aid comprises a tripartite structure including, in sequence, a flexible, electrically insulating strip; a metallized layer on said strip, and an adhesive layer on said metallized layer. An integral impedance connector couples one end of the starting aid to a base pin of the lamp.

This construction attaches easily to the lamp by means of the adhesive and the integral impedance connector can be rolled and inserted into the base cap. A single element, such as a wire, couples one side of the impedance to a base pin. The system works well on metal or plastic capped lamps and provides a secure connection. Further, the entire starting aid and integral coupling are formed from readily available materials.

BEST MODE FOR CARRYING OUT THE INVENTION

For a better understanding of the present invention together with other and further objects, advantages and capabilities thereof, reference is made to the following disclosure and appended claims taken in conjunction with the above-described drawings.

Figure 1:
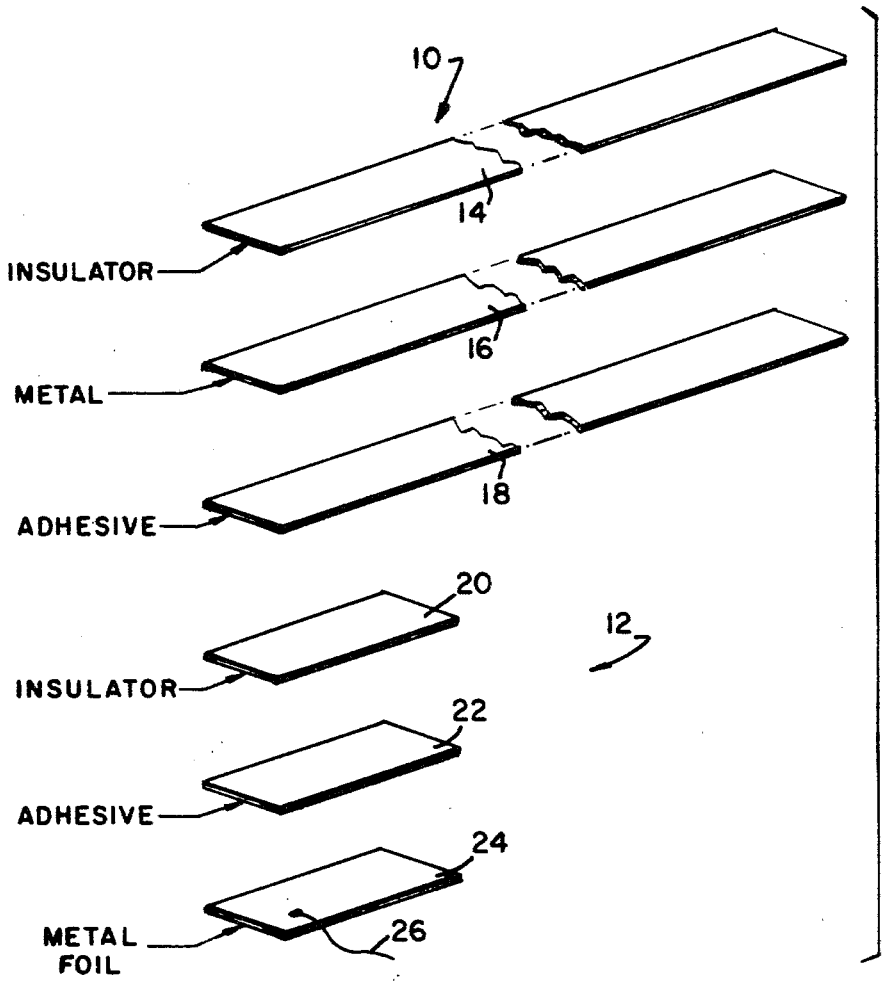
FIG. 1 is an exploded, perspective view of the starting aid and integral impedance coupling.

Referring now to the drawings with greater particularity, there is shown in FIG. 1 a starting aid 10 including an integral impedance connector 12.

The starting aid 10 comprises a tripartite structure including in sequence a flexible electrically insulating strip 14, a metallized layer 16 on strip 14 and an adhesive layer 18 on the metallized layer 16. The starting aid 10 has a length substantially equal to the length of the fluorescent lamp with which it is employed. A width of approximately ¼ inch is suitable and the thicknesses of the materials should be as thin as practical to achieve the desired results and to promote ease of handling. A metallized polyester film adhesive tape of suitable dimensions is commercially available from 3M Company, under the name of Scotch Brand No. 850.

The impedance connector 12 comprises, in sequence, a second strip 20 of flexible electrically insulating material, shorter in length than strip 14, which is attached to adhesive layer 18 at one end of starting aid 10. Second strip 20 carries a second adhesive layer 22 which in turn is attached to a metal foil 24 which has attached thereto a connecting wire 26, as by soldering or welding.

The second strip 20 can be Mylar and such a strip with an adhesive backing is available commercially from 3M Company. The metal foil 24 can be copper or brass having a thickness of about 1 mil.

Figure 2:
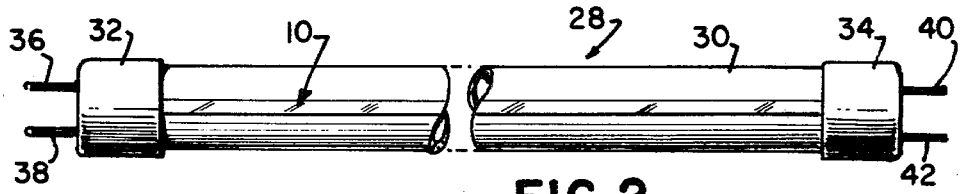
FIG. 2 is a view of a fluorescent lamp with a starting aid in position thereon.
Figure 3:
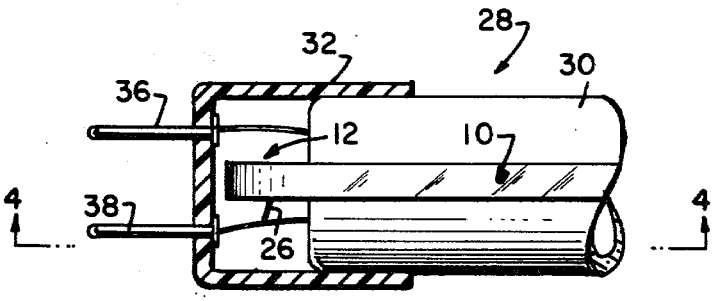
FIG. 3 is a partial sectional view of a base cap of the lamp showing the integral impedance coupling.
Figure 4:
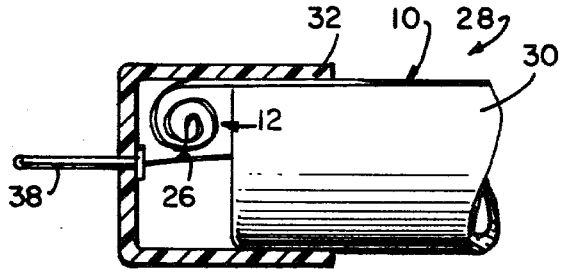
FIG. 4 is a sectional view taken along the line 4—4 of FIG. 3.

In FIG. 2 is shown a fluorescent lamp 28 comprising a tubular glass portion 30 sealed by end caps 32 and 34 each of which has a pair of lead-in wires 36, 38 and 40, 42 extending therefrom. Starting aid 10 is shown as being fastened to lamp 28, by means of adhesive layer 18, and extending longitudinally therealong.

The integral impedance connector 12 is rolled into a spiral and is carried within one of the end caps, in this instance 32, and connecting wire 26 has its free end connected to one of the lead-in wires; e.g. 38.

In operation, the lamp voltage at lead-in wire 38 is transferred by wire 26 to metal foil 24 of the impedance connector 12. This charges foil 24 to the lead-in potential which charge is then capacitively transferred through second strip 20 to starting aid 10 which is attached to lamp 28. The second strip 20 forms the dielectric component of a capacitor whose plates are the metal foil 24 and the metallized layer 16 of the starting aid 10. The metallized layer 16 transmits the lead-in potential along the lamp wall in a manner identical to that of a conventional conducting stripe.

There is herein provided a novel starting aide that overcomes the disadvantages of the prior art. A coupling impedance is included as an integral part of the starting aid thus eliminating the difficult requirement of making electrical contact with a metallized layer or conductive paint stripe. Also eliminated is the need for a separate and discrete impedance element. A further advantage is the ease of application of the starting aid to the lamp; and the fact that the coupling impedance can be rolled into a cylinder and enclosed in the end cap.

While there have been shown and described what are at present considered to be the preferred embodiments of the invention, it will be apparent to those skilled in the art that various changes and modifications can be made herein without departing from the scope of the invention as defined by the appended claims.

I claim:

1. A starting aid for a fluorescent lamp, said starting aid comprising a tripartite structure including in sequence a flexible electrically insulating strip; a metalized layer on said strip; and a first adhesive layer on said metalized layer; and an integral impedance connector coupling one end of said starting aid to a base pin of said lamp, said impedance connector comprising, in sequence, a second strip of flexible electrically insulating material attached to said first adhesive layer at a position remote from the bulb of said fluorescent lamp; a second adhesive layer; and a strip of metal foil adhered to said second adhesive layer.

2. The starting aid of claim 1 wherein said first adhesive layer is adhered to said bulb of said fluorescent lamp and extends longitudinally therealong for substantially the entire length of said bulb.

3. The starting aid of claim 2 wherein said impedance connector is contained within the base cap of said fluorescent bulb.

* * * * *